US007692121B2

(12) United States Patent
Pinilla et al.

(10) Patent No.: US 7,692,121 B2
(45) Date of Patent: Apr. 6, 2010

(54) TEMPERATURE CONTROL FOR AN INDUCTIVELY HEATED HEATING ELEMENT

(75) Inventors: José Miguel Burdio Pinilla, Zaragoza (ES); Ignacio Esteras Duce, Zaragoza (ES); Jose Ramon Garcia Jiménez, Zaragoza (ES); Pablo Jesus Hernandez Blasco, Zaragoza (ES); Sergio Llorente Gil, Zaragoza (ES); Fernando Monterde Aznar, Zaragoza (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 444 days.

(21) Appl. No.: 10/556,929

(22) PCT Filed: Oct. 28, 2003

(86) PCT No.: PCT/EP03/11961

§ 371 (c)(1),
(2), (4) Date: Feb. 11, 2008

(87) PCT Pub. No.: WO2004/103028

PCT Pub. Date: Nov. 25, 2004

(65) Prior Publication Data

US 2008/0121633 A1 May 29, 2008

(30) Foreign Application Priority Data

May 15, 2003 (ES) ..... 200301242

(51) Int. Cl.
*H05B 1/02* (2006.01)
*H05B 3/68* (2006.01)

(52) U.S. Cl. ..... 219/494; 219/497; 219/443.1; 219/667; 219/627; 219/448.11

(58) Field of Classification Search ..... 219/494, 219/497, 501, 626, 627, 665, 667, 624
See application file for complete search history.

(56) References Cited

U.S. PATENT DOCUMENTS 3,781,506 A 12/1973 Ketchum et al.

(Continued)

FOREIGN PATENT DOCUMENTS

DE 916 103 8/1954

(Continued)

OTHER PUBLICATIONS

International Search Report PCT/EP03/11961.

*Primary Examiner*—Mark H Paschall
(74) *Attorney, Agent, or Firm*—James E. Howard; Andre Pallapies

(57) ABSTRACT

A temperature control and method of operating the temperature control, for an inductively heated heating element. The heating element is heated by an inductor to which electrical power is supplied via a control circuit, which can also be a control circuit for an induction hob or oven. The temperature control is activated at a first point in time subject to at least one electrical value of the control circuit, which depends on the temperature of the heating element. A reference value is determined at the first point in time and a comparison value and a deviation value from the reference value is determined at least one later point in time. Depending upon the deviation value, the inductor is supplied with power so that the heating element is adjusted to a substantially constant value corresponding to the reference value.

19 Claims, 7 Drawing Sheets

U.S. PATENT DOCUMENTS

Figure 1:
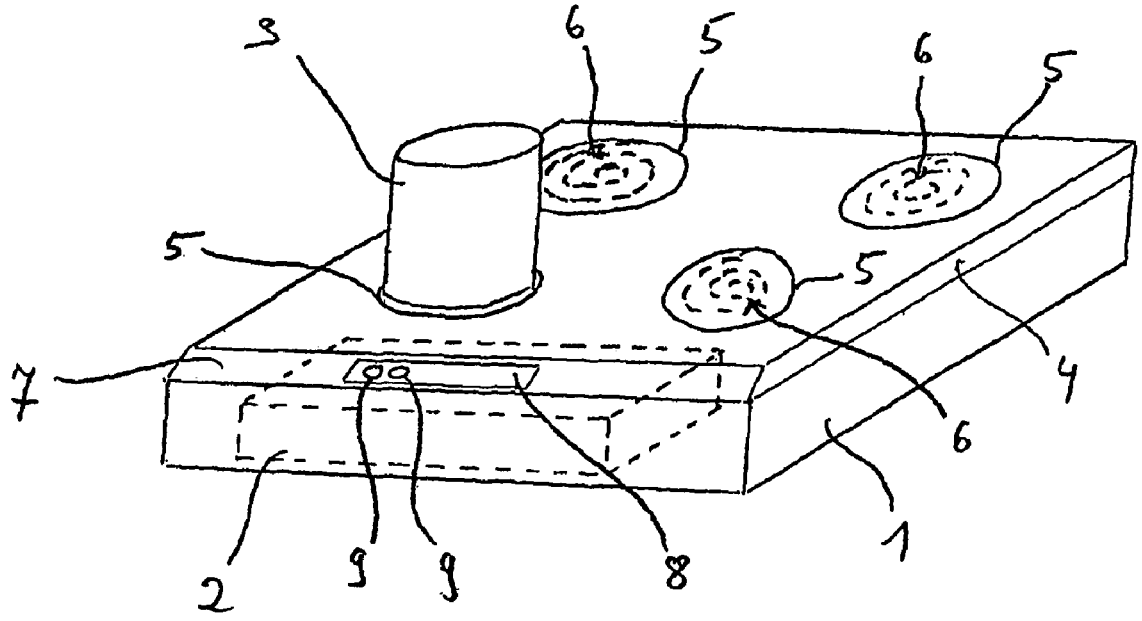

| | | | | | |
|---|---|---|---|---|---|
| 4,280,038 | A | * | 7/1981 | Havas et al. | 219/666 |
| 4,481,639 | A | | 11/1984 | Archenholtz et al. | |
| 4,638,135 | A | | 1/1987 | Aoki | |
| 4,798,925 | A | | 1/1989 | Ishizaka | |
| 5,408,073 | A | | 4/1995 | Jeong | |
| 5,477,035 | A | | 12/1995 | Matsumoto et al. | |
| 5,488,214 | A | | 1/1996 | Fettig et al. | |
| 6,163,019 | A | | 12/2000 | Green et al. | |

FOREIGN PATENT DOCUMENTS

| | | |
|---|---|---|
| DE | 26 22 825 | 12/1977 |
| DE | 37 31 555 | 12/1988 |
| DE | 195 40 408 | 5/1997 |
| DE | 196 09 930 | 9/1997 |
| DE | 198 52 617 | 1/2000 |
| DE | 101 60 087 | 9/2002 |
| EP | 0 888 033 | 12/1998 |
| WO | WO 97/16943 | 5/1997 |
| WO | WO 2004/103028 | 11/2004 |

* cited by examiner

FIG. 3B
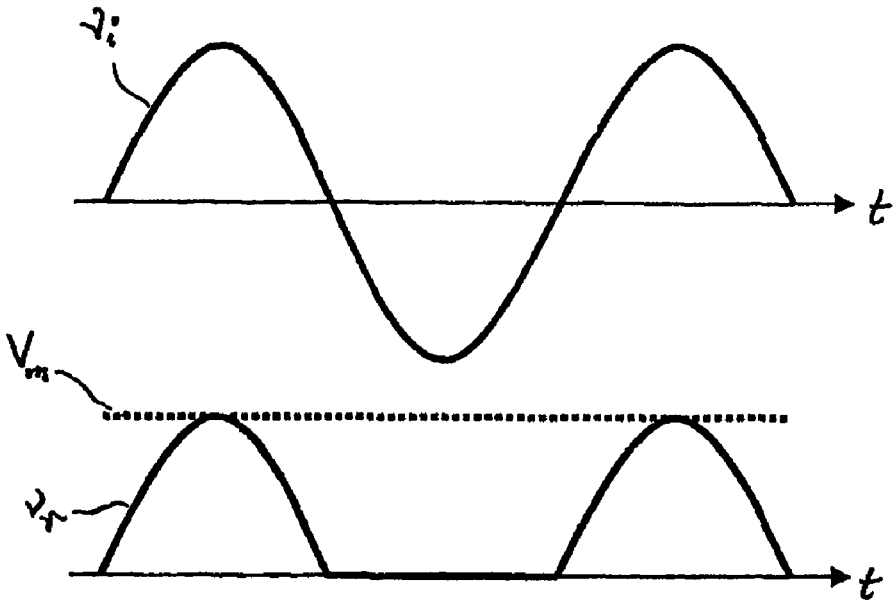
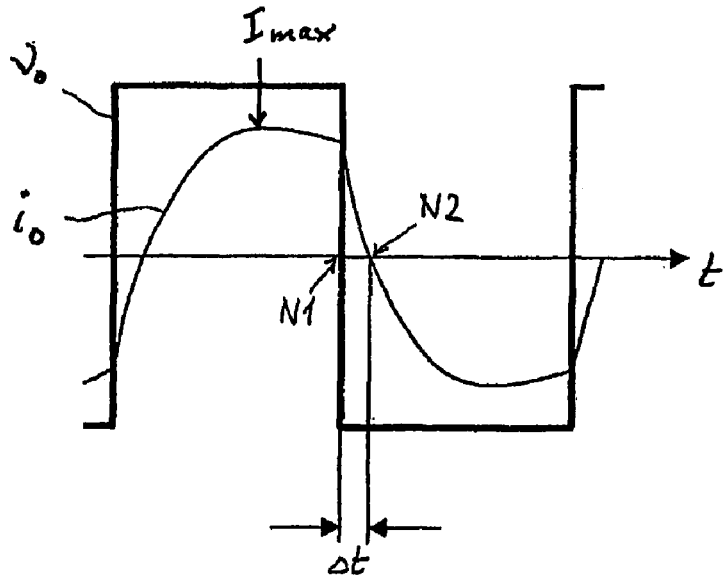
FIG. 3C

TEMPERATURE CONTROL FOR AN INDUCTIVELY HEATED HEATING ELEMENT

The present invention relates to a method for temperature control of a heating element, which is heated inductively by an inductor, to which electric power is supplied via a control circuit and a corresponding control circuit, as well as an induction hob and an induction oven with such a control circuit.

Heating a heating element via induction is known. At the same time a loss in power of a high-frequency alternating field, which is generated by an induction coil, the so-called inductor, via magnetic coupling in a part of the heating element, results in heating of the heating element. This principle is used e.g. for induction hobs, in which the heat of a cooking vessel is generated in its floor by induction.

U.S. Pat. No. 3,781,506 discloses a method for measuring and regulating the temperature of an inductively heated cooking vessel in an induction cooker. With this method a parameter of a switching circuit is measured, which supplies the inductor with electric power. This parameter is influenced by heating the cooking vessel so that its value varies with change in temperature of the cooking vessel. The temperature of the cooking vessel can be determined from the measured value of the parameter by means of a temperature characteristic of the parameter.

The disadvantage of the method put forward in U.S. Pat. No. 3,781,506 is that it works only for a cooking vessel, for which the temperature characteristic of the parameter is known and for which the method has been calibrated. In other words, for cooking vessels deviating in their heating behaviour from the characteristic basic to the method the method is very imprecise. This applies also for cooking vessels, whereof the heating behaviour changes over time from wear.

The object of the invention is to provide a method for temperature control of an inductively heated heating element, which functions independently of the state of the heating element and for different heating elements.

This task is solved by a method of the type initially specified by the fact that the temperature control is activated at a first point in time, that depending on at least one electric variable of the control circuit, which depends on the temperature of the heating element, at this first point in time a reference value or respectively a set point is determined, that depending on the electric variable at least a later point in time a comparative value or respectively an actual value and a deviation of this comparative value from the reference value is determined, and that power is supplied to the inductor depending on the deviation, so that the temperature of the heating element is regulated to a constant value corresponding to the reference value.

In addition to this, the task is solved by a control circuit of the type initially specified by the fact that the control circuit comprises a control element for activating the temperature control, that the control circuit comprises at least one measuring instrument for determining at least an electric variable of the control circuit, which depends on the temperature of the heating element, that the control circuit is designed for determining a reference value dependent on the electric variable at an activating point in time of the temperature control and for determining a comparative value dependent on the electric variable at least a later point in time, that the control circuit comprises a comparison unit for determining a deviation of the comparative value from the reference value, and that the control circuit comprises a control unit for controlling the power regulator depending on the deviation, for temperature control of the heating element to a constant value corresponding to the reference value.

By the reference value being determined and then compared to the comparative value at the activating point in time of temperature control depending on the electric variable of the control circuit, which is determined at least a later point in time depending on the electric variable of the control circuit, it is easily ensured that the temperature control is independent of the choice of the heating element at a temperature corresponding to the reference value. It is also beneficial that the temperature of the heating element can thus be regulated without knowledge of a specific temperature characteristic of the electric variable for the heating element.

In this way the temperature control itself is then functional if the heating element is positioned imprecisely to the inductor.

According to a preferred embodiment it is provided that the temperature control can be activated by a user actuating a control element, which is in particular at least a switch or at least a contact sensor.

The user can determine the desired temperature of the heating element, in that he then activates the temperature control e.g. in an induction cooking zone of an induction hob, if water in a cooking vessel on this induction cooking zone begins to boil or cooked goods are to be kept in the cooking vessel at a temperature determined subjectively by the user. The temperature of the heating element, such as e.g. the cooking vessel, is maintained after activating the temperature control, without the absolute temperature of the heating element having to be determined with a sensor. The electric power is adjusted automatically to keep the temperature of the heating element at the temperature corresponding to the reference value and subsequent manual regulating of the electric power by the user is also then not necessary, if e.g. during a cooking procedure more cold cooked goods are added to the cooking vessel.

By way of advantage the comparative value of the electric variable can be determined at preset, in particular periodic, time intervals. In this way the accuracy of the temperature control is increased, since changes to the temperature of the heating element are detected by e.g. external influences at regular time intervals and the electric power supplied to the inductor is accordingly readjusted to keep the temperature constant.

In order to keep expenditure for the temperature control to a minimum, in a preferred embodiment the electric variable, from which the reference value and/or the comparative value is determined, in particular calculated, is the electric power and/or a mean voltage and/or a mean current, since these electric variables of the control circuit can be detected particularly easily.

According to a preferred embodiment the reference value and/or the comparative value are determined at a preset frequency of the electric variable.

The advantage of this procedure is that frequency-dependent influences of the heating element or the determining of the reference value or respectively of the comparative value are prevented, whereby the accuracy of the temperature control can be increased.

Figure 2:
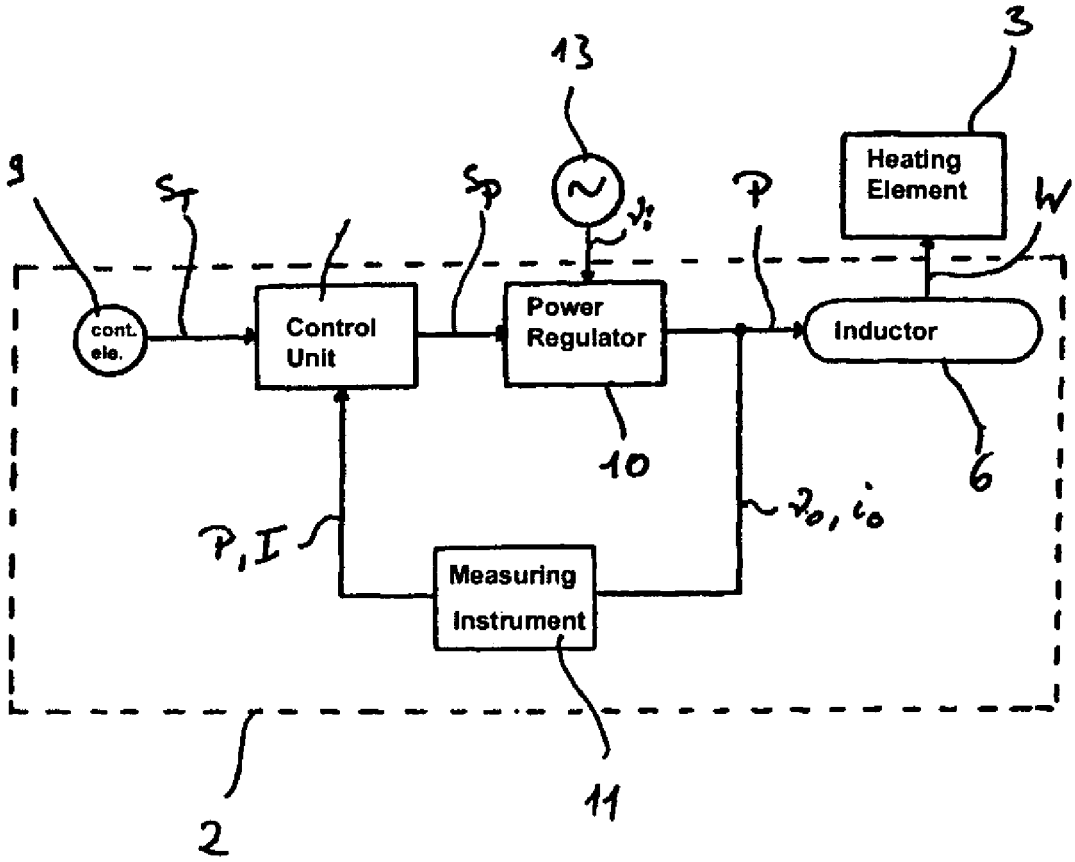
Figure 3A:
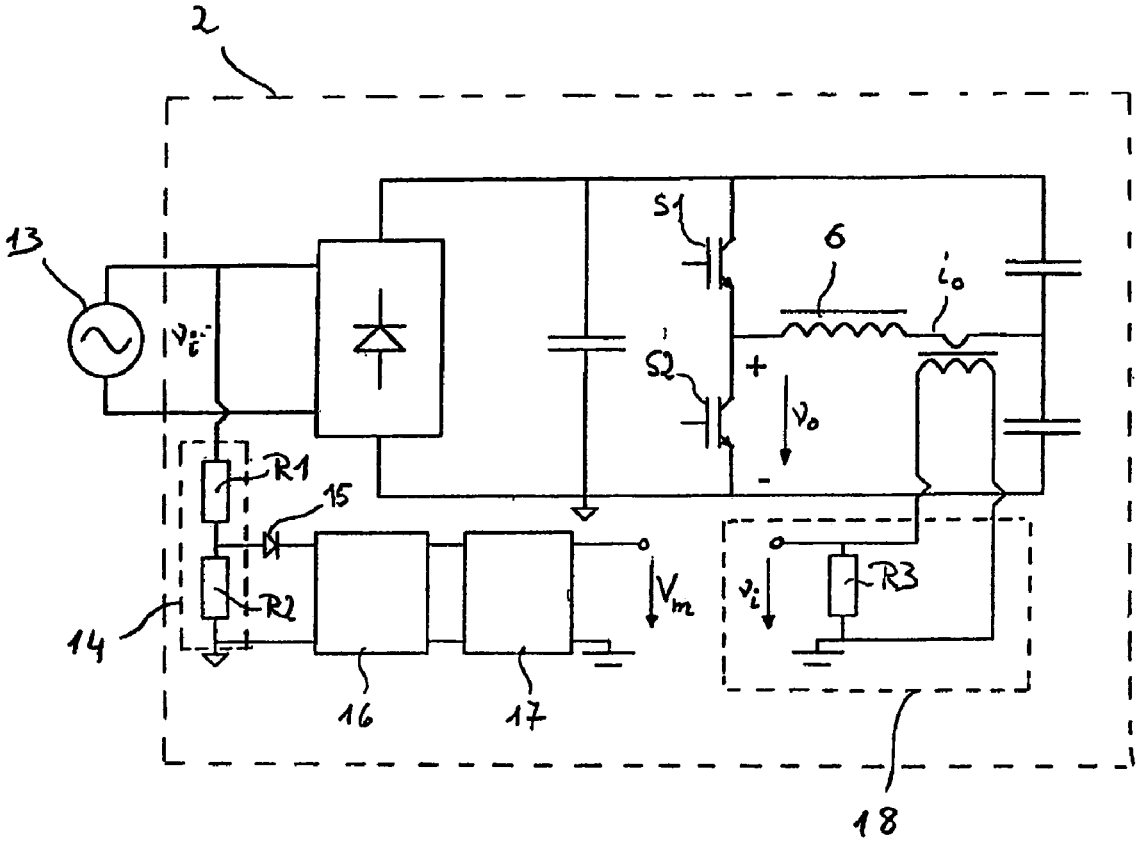
Figure 4:
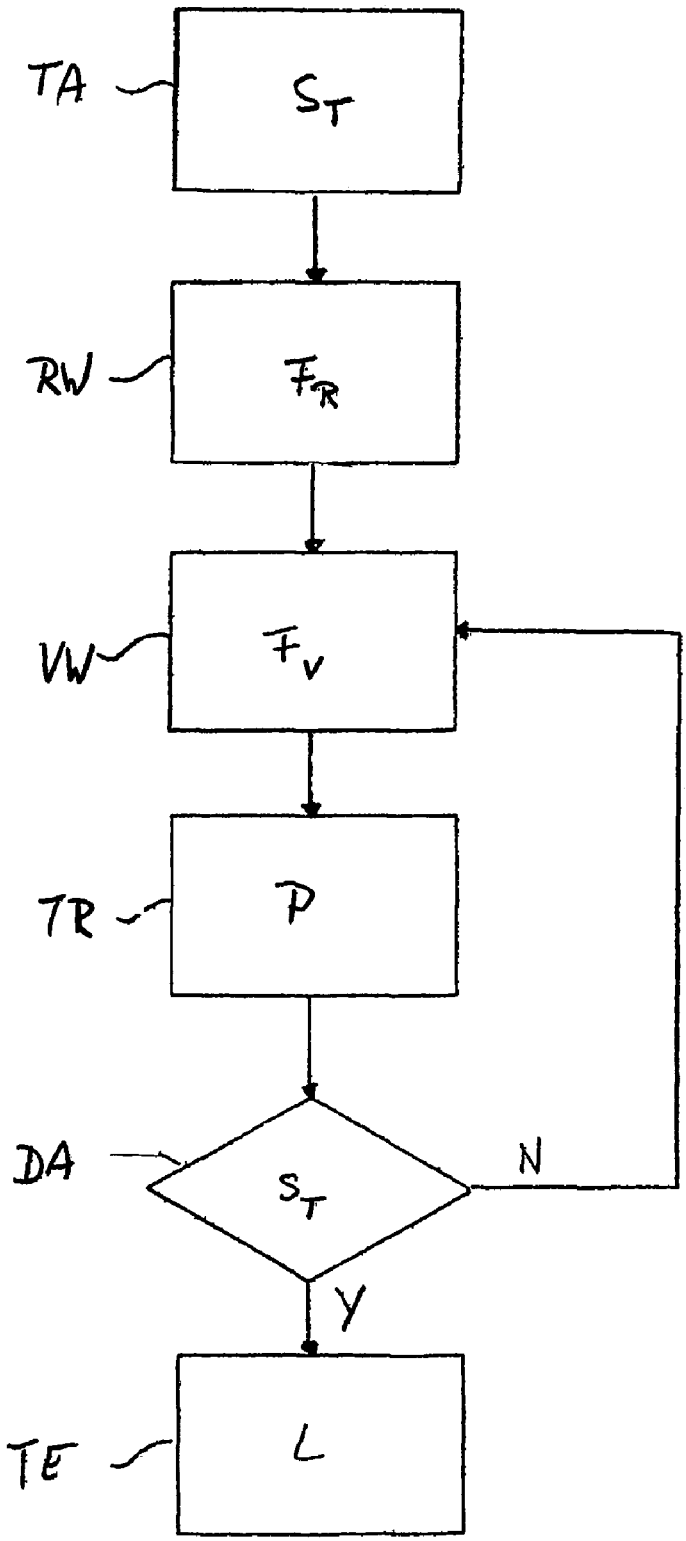
Figure 5:
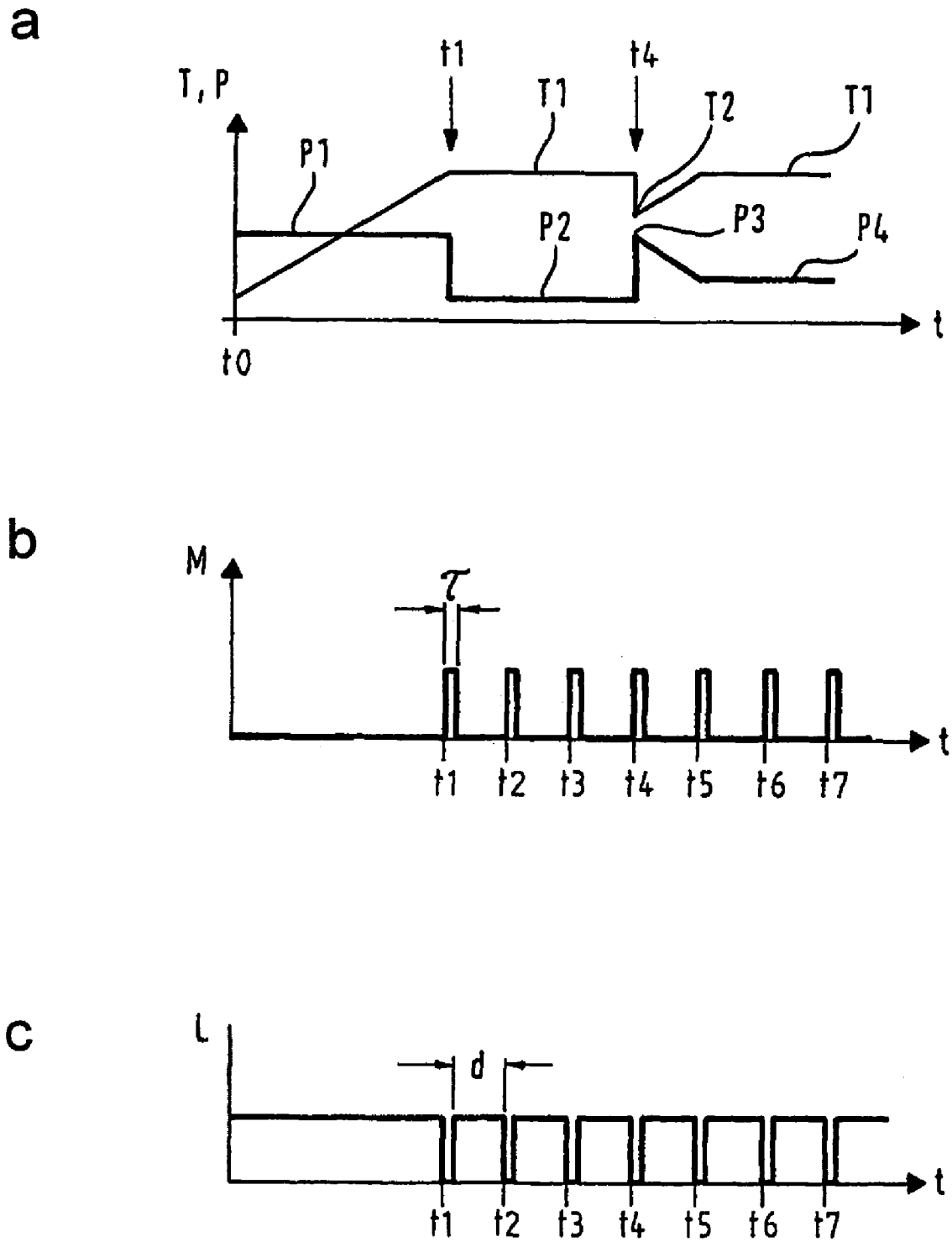
Figure 6:
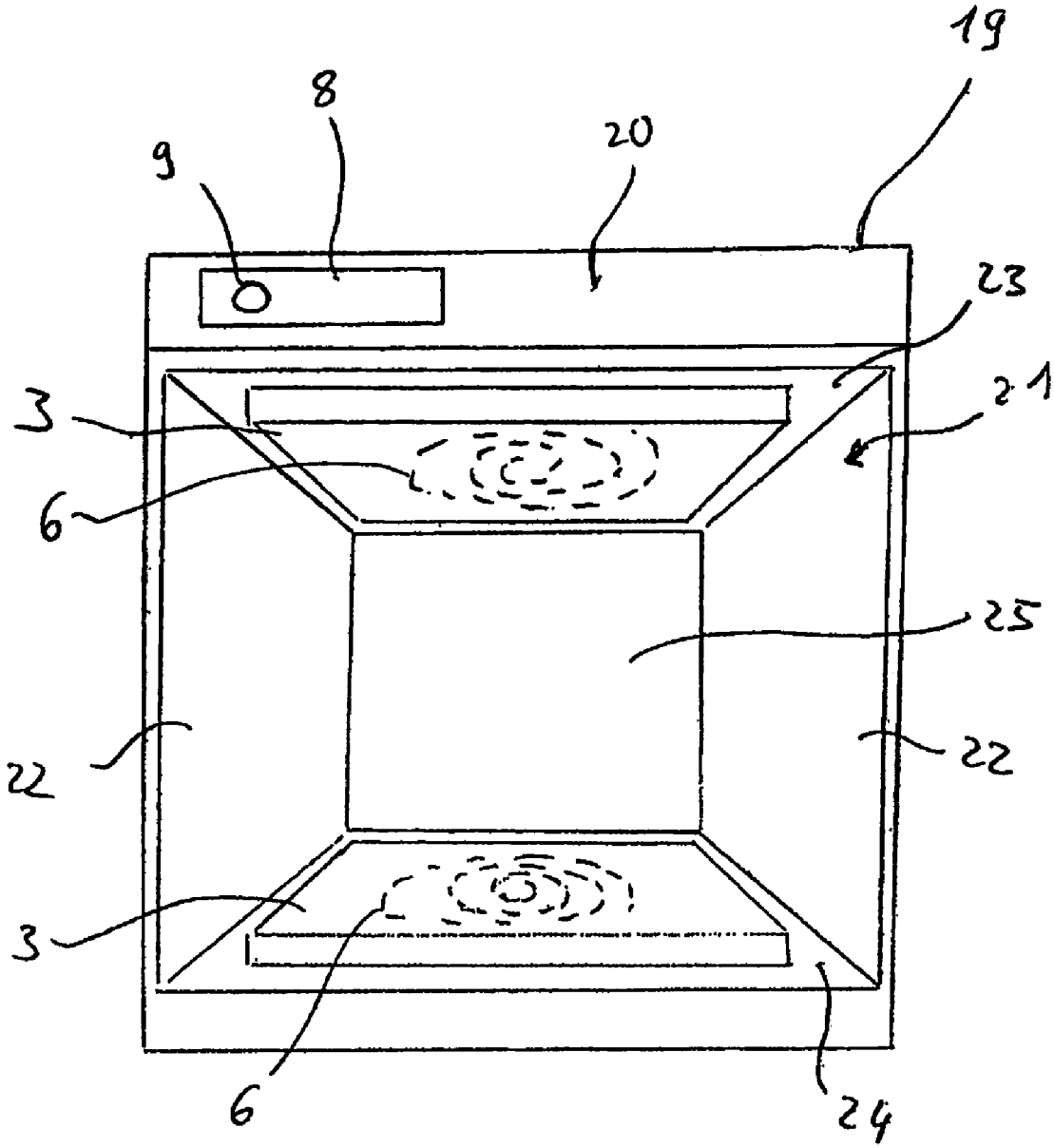

The invention and its further developments will now be explained in greater detail hereinbelow by means of diagrams, in which:

FIG. 1 shows a schematic illustration of an induction hob with a control circuit for temperature control, FIG. 2 shows a system sketch of the control circuit, FIG. 3*a* shows a detailed sketch of the control circuit, FIG. 3*b* shows a schematic time sequence of input voltage of the control circuit, FIG. 3*c* shows a schematic time sequence of an output voltage and an output current of the control circuit, FIG. 4 shows a flow chart diagram of the temperature control of the heating element, FIG. 5 schematically shows a time sequence of the temperature control, FIG. 6 shows a schematic illustration of an induction oven with temperature control.

FIG. 1 shows a hob 1 with a control circuit 2 for temperature control of a cooking vessel 3. The induction hob 1 has a glass ceramic plate 4 with four induction cooking zones 5, in each position whereof an inductor 6 is located under the glass ceramic plate. The cooking vessel 3 is heated by one of the inductors 6. A control unit 8 is arranged on a front 7 of the glass ceramic plate to operate the inductor 6. This control unit 8 comprises control elements 9 for activating and deactivating the temperature control.

As shown in FIG. 2, the control circuit 2 comprises the inductor 6 for inductive heating of a heating element 3, such as for example the cooking vessel 3 in FIG. 1, a power regulator 10 for regulating electric power P supplied to the inductor 6, a measuring instrument 11 for measuring electric variables $v_o$, $i_o$, P, I of the control circuit 2, a control element 9 for activating and deactivating the temperature control and a control unit 12, such as e.g. a microprocessor, for controlling the power regulator 10. The control circuit 2 is supplied by a voltage source 13 with an input voltage u, which is alternating voltage. The power regulator 10 usually comprises a converter (not shown), which converts the input voltage $v_i$, with an input frequency of for example 50 Hz to an output voltage $v_o$, in a higher frequency range, e.g. above 25 kHz. Various principles are known, e.g. periodic on-and-off switching of the output voltage $v_o$, frequency matching of the output voltage $v_o$ or control current change, for controlling the output, which is pre-set e.g. by a rotary switch of the control unit 8. The temperature control is activated by the control element 9 via a control signal ST to the control unit 12. The electric variables $v_o$, $i_o$, P, I of the control circuit 2 detected by the measuring instrument 11 are fed to the control unit 12, where they are processed into a control signal for power control $S_p$. Due to the control signal for the power control $S_p$, which is supplied to the power regulator 10, the electric power P supplied to the inductor 6 is regulated and thus heat output W generated in the heating element 3.

FIG. 3*a* shows a detailed sketch of the control circuit 2. The control circuit 2 is supplied via the voltage source 13 with the input voltage v. The level of this input voltage $v_i$ is reduced by means of a voltage divider 14, which comprises two resistors R1, R2, and converted by means of a rectifier 15 into a rectified input voltage $v_r$. The positions of voltage maximums $V_m$ in a time sequence of the rectified input voltage $v_r$ are detected by a peak detector 16 and connected downstream of high-voltage insulation 17, and a value of the voltage maximums $V_m$ is captured. In FIG. 3*b* the sequence of the input voltage vi and the sequence of the rectified input voltage vr are shown via a time axis t. In the sequence of the rectified input voltage vr the value of the voltage maximums VM is characterised.

The electric power P supplied to the inductor 6 is adjusted by the power regulator 10 by means of two high-frequency switches S1, S2, which can for example be semiconductor power elements. Applied to the inductor is output voltage $v_o$ and an output current $i_o$ flows. Both these electric variables $v_o$, $i_p$ are influenced by a change in resistance of the heating element 3, depending on the heating elements 3 and its temperature T. The output current $i_o$ is detected by means of a current voltage converter 18, to the resistance R3 whereof voltage $v_i$ is applied, which is proportional to the output current $i_o$. FIG. 3*c* schematically shows the detected time sequence of the output voltage $v_o$ and of the output current $i_o$. A further alternative measuring variable, which depends on the temperature T of the heating element 3, is for example a phase shift Δt between output voltage $v_p$ and output current $i_o$, which can be determined e.g. by way of a zero crossing N1 of the output voltage $v_o$ and a zero crossing N2 of the output current $i_o$. Other electric variables of the control circuit 2 can also be measured, which depend on the temperature T of the heating element 3, such as for example mean electric power P, a mean rectified current I, maximum current Imax or a frequency of the output voltage vo or of the output current $i_o$.

The mean electric power P can be determined from the product of output voltage $v_o$ and output current $i_o$ $$P = \frac{1}{\tau} \cdot \int_0^{\tau} v_o \cdot i_o \cdot dt,$$

whereby abs($i_o$) designates an information period τ. The mean rectified current I is determined according to $$I = \frac{1}{\tau} \cdot \int_0^{\tau} \mathrm{abs}(i_o) \cdot dt,$$

whereby abs ($i_0$) designates an absolute amount of the output current $i_o$. An alternative is determining the root of the square average value $I_{rms}$ of the output current $i_o$. The mean electric power P and the mean rectified current I are captured by the measuring instrument 11 and fed to the control unit 12. In the control unit 12 a value of a function F is calculated from the mean electric power P and the mean rectified current I as follows $$= k_P \cdot \frac{P}{V_{rms}^2} + K_1 \cdot \frac{1}{V_{rms}}$$

whereby $k_p$ and $k_I$ are constants, which are determined experimentally, to achieve maximum variation of the functional value F with the temperature T of the heating element 3. $V_{ms}$ designates the root of the square average value of the input voltage $v_i$. Other functions F are also possible, for example the function F can also be an impedance of the heating element 3 and the inductor 6, which is determined from a ratio of mean power P to a square of the mean current I.

FIG. 4 shows a flow control chart of the temperature control of the heating element 3. In a first procedural step TA the temperature control is activated by a control signal ST. Normal power control of the power P selected by the control unit 8 is transferred to the power control by means of temperature control. In addition to this, a reference value $F_R$ is determined from the current value of the function F, which, depending on at least one of the electric variables is $v_o$, $i_o$, P, I of the control circuit 2, depending on the temperature T of the heating element 3, for activating the temperature control in a second procedural step RW virtually at the same time. In the next procedural step VW, depending on the electric variable $v_o$, $i_o$, P, I a comparative value $F_V$ is determined from the function F and a deviation of this comparative value $F_V$ is determined from the reference value $F_R$. In the next procedural step TR electric power P is supplied to the inductor 6 depending on the deviation, so that the temperature T of the heating element 3 is regulated to a constant value corresponding to the reference value $F_R$. In a next procedural step DA a check is made as to whether a signal $S_T$ for deactivating the temperature control is present. If this is not the case N the procedural step VW is continued. If there is a signal $S_T$ for deactivating the temperature control Y, the temperature control ends in the next procedural step TE and a power control L of the electric power P is carried out without temperature control with the power regulator 10 corresponding to the power P selected by means of the control unit 8.

FIG. 5 schematically illustrates a time sequence of the temperature control. At a point in time t0 the inductor 6 is activated with the heating element 3, and electric power P1 selected by means of the control unit 8 is supplied to the inductor 6, which is controlled by the power regulator 10 and the heating element 3 is heated to a temperature T1. At a point in time t1 the temperature control is activated by a user actuating the control element 9, which is for example a switch or a contact sensor. At this first point in time t1 the reference value $F_R$ is determined, and at later points in time t2 to t7, which lie advantageously at periodic time intervals, in each case the comparative value $F_V$ is determined. During the information period τ, required by the measuring instrument 11 for measuring M the electric variables $v_o$, $i_o$, P, 1, the frequency of the output voltage $v_o$ or respectively of the output current $i_o$ is adjusted to a preset value and the power control L of the power regulator 10 is interrupted for that time. Because the information period τ is typically in the variable order of 10 to 800 milliseconds, this time period is negligibly small compared to the typical duration d of the power control L of 5 to 15 seconds.

As soon as the temperature control is activated, the electric power supplied to the inductor 6 by the output value P1 is reduced to a lesser output value P2, so as to keep constant the temperature value T1 of the heating element 3. At a point in time t4 the heating element 3 is cooled by an external influence, for example with cold liquid being supplied to a cooking vessel 3. This cooling of the heating element 3 to a temperature value T2 is detected through deviation of the comparative value $F_V$ by the reference value $F_R$. The effect of the temperature control is an increase in the electric power supplied to the inductor 6 to a value P3, to reheat the heating element 3 to the temperature T1. Until the temperature T1 is again reached the electric power P supplied to the inductor 6 can be reduced step by step to a value P4. This output value P4 is now fed to the inductor 6 in order to keep the heating element 3 at the constant temperature value T1. The temperature control remains active until such time for example as it is deactivated through actuating of the control element 9 by the user. Another possibility for deactivating the temperature control is for example removing the heating element 3 from the inductor 6, deactivating the inductor 6 by the user or another power default setting for the inductor 6 via the control unit 8.

FIG. 6 schematically illustrates an induction oven 19 as a further exemplary application for temperature control of the inductively hated heating element 3. The control unit 8 of the induction oven 19, located on a front side 20 of the induction oven, comprises the control element 9 for activating and deactivating the temperature control. A loading opening 21 of the induction oven 19 is delimited by side walls 22, a cover wall 23 and a floor 24, as well as a rear wall 26 and a door (not shown in FIG. 6). The inductors 6 are situated for example on the cover wall 23 and on the floor 24 of the induction oven 19 and are covered by the heating elements 3. The inductors 6 and the heating elements 3 can likewise be arranged on the side walls 22. Alternatively, the heating element 3 can also be a baking tray, such as for example a baking sheet, or one of the side walls 22, the cover wall 23 or the floor 24.

LEGEND

1 induction hob
2 control circuit
3 heating element, cooking vessel, baking tray
4 glass ceramic plate
5 induction cooking zones
6 inductor
7 front of glass ceramic plate
8 control unit
9 control element for activating/deactivating temperature control
10 power regulator
11 measuring instrument
12 control unit, microprocessor
13 voltage supply
14 voltage divider
15 rectifier
16 peak detector
17 high-voltage insulation
18 current voltage converter
19 induction oven
20 front side of the induction oven
21 loading opening of induction oven
22 side wall of the induction oven
23 cover wall of induction oven
24 floor of induction oven
25 rear wall of the induction oven
d duration of output control
$F_R$ reference value
$F_V$ comparative value
$i_o$ output current of control circuit
I mean current
$I_{max}$ maximum value of current
L output control with power regulator
M measuring of electric variables
N1 zero crossing of output voltage
N2 zero crossing of output current
P electric power
R1 resistance of voltage divider
R2 resistance of voltage divider
R3 resistance of current voltage converter
$S_T$ control signal for activating/deactivating temperature control
$S_P$ control signal for power regulation
S1 high-frequency switch
S2 high-frequency switch
t time axis
Δt phase shift between output voltage and output current
τ information period for the temperature control
T temperature of heating element
$v_i$ input voltage of control circuit
$v_r$ rectified input voltage
$v_o$ output voltage of control circuit
vi voltage proportional to output current
$V_m$ maximum value of rectified input voltage
W heat output
AT activating temperature control
RW determining reference value
VW determining comparative value and its deviation from the reference value TR power output corresponding to temperature control
DA query as to whether temperature control is deactivated
TE end of temperature control
N signal for deactivating temperature control not present
Y signal for deactivating temperature control present.

The invention claimed is:

1. A method for temperature control of a heating element, which is heated inductively by an inductor, to which electric power (P) is supplied via a control circuit, comprising:

activating the temperature control at a first point in time (t1) (ΔT);

determining at said first point in time (t1) a reference value ($F_R$) depending on at least one electric variable ($v_o$, $i_o$, P, I) of the control circuit, said electric variable depending on the temperature (T) of the heating element; and ensuring that said temperature (T) of said heating element conforms to a predetermined temperature value at at least one later point in time (t2-t7), said ensuring including determining at a later point in time (t2-t7) a comparative value ($F_v$) depending on said electric variable ($v_o$, $i_o$, P, I), determining a deviation of said comparative value ($F_V$) from said reference value ($F_R$), and, in the event that said comparative value ($F_V$) deviates from said reference value ($F_R$), supplying power (P) to the inductor depending on said deviation.

2. The method according to claim 1, including activating said temperature control by a user actuating a control element.

3. The method according to claim 1, including determining said comparative value ($F_V$) of said electric variable (vo, io, P, I) at preset time intervals (t2-t7).

4. The according to claim 3, including said preset time intervals (t2-t7) are periodic.

5. The method according to claim 1, including said electric variable is at least one of the electric power (P) and a mean voltage and a mean current (I).

6. The method according to claim 1, including at least one of said reference value ($F_R$) and said comparative value ($F_V$) is an impedance of said heating element and said inductor.

7. The method according to claim 1, including calculating at least one of said reference value ($F_R$) and said comparative value ($F_V$) from said electric variable (vo, io, P, I).

8. The method according to claim 2, including deactivating said temperature control by the user actuating said control element.

9. The method according to claim 2, including deactivating said temperature control by the user removing said heating element.

10. The method according to claim 1, including determining at least one of said reference value ($F_R$) and said comparative value ($F_V$) at a preset frequency of said electric variable (vo, io).

11. A control circuit for inductive heating of a heating element by an inductor, comprising:

a power regulator for controlling electric power (P) supplied to the inductor;

a temperature control for the heating element;

the control circuit including a control element for activating said temperature control;

said control circuit including at least one measuring instrument for determining at least one electric variable ($v_o$, $i_o$, P, I) of said control circuit, said electric variable depends on the temperature (T) of said heating element;

in that the control circuit (2) is operable to ensure that said temperature (T) of said heating element conforms to a predetermined temperature value at at least one later point in time (t2-t7) in that said control circuit is designed for determining a reference value ($F_R$) dependent on the electric variable ($v_o$, $i_o$, P, I) at an activating point in time of the temperature control and for determining a comparative value ($F_V$) dependent on the electric variable ($v_o$, $i_o$, P, I) at at least a later point in time (t2-t7), in that the control circuit (2) comprises a comparison unit (12) for determining a deviation of the comparative value ($F_V$) from the reference value ($F_R$), and in that the control circuit (2) comprises a control unit (12) for controlling the power regulator (10) independently of the deviation, for temperature control of the heating element (3) to a constant value corresponding to the reference value ($F_R$).

12. The control circuit according to claim 11, including said control element for activating said temperature control is one of at least a switch or a contact sensor.

13. The control circuit according to claim 11, including said measuring instrument for determining at least one electric variable ($v_o$, $i_o$, P, I) of said control circuit includes at least one of a voltage measuring instrument and a current measuring instrument.

14. The control circuit according to claim 13, including said measuring instrument includes at least one current voltage converter.

15. The control circuit according to claim 11, including said control circuit includes a microprocessor.

16. An induction hob, comprising a control circuit for inductive heating of at least one heating element by an inductor in the induction hob;

said control circuit including, a power regulator for controlling electric power (P) supplied to the inductor;

a temperature control for the heating element;

the control circuit including a control element for activating said temperature control;

said control circuit including at least one measuring instrument for determining at least one electric variable ($v_o$, $i_o$, P, I) of said control circuit, said electric variable depends on the temperature (T) of said heating element;

in that the control circuit (2) is operable to ensure that said temperature (T) of said heating element conforms to a predetermined temperature value at at least one later point in time (t2-t7) in that said control circuit is designed for determining a reference value ($F_R$) dependent on the electric variable ($v_o$, $i_o$, P, I) at an activating point in time of the temperature control and for determining a comparative value ($F_V$) dependent on the electric variable ($v_o$, $i_o$, P, I) at at least a later point in time (t2-t7), in that the control circuit (2) comprises a comparison unit (12) for determining a deviation of the comparative value ($F_V$) from the reference value ($F_R$), and in that the control circuit (2) comprises a control unit (12) for controlling the power regulator (10) independently of the deviation, for temperature control of the heating element (3) to a constant value corresponding to the reference value ($F_R$).

17. An induction oven, comprising:

a control circuit for inductive heating of at least one heating element by an inductor in the induction oven;

said control circuit including, a power regulator for controlling electric power (P) supplied to the inductor;

a temperature control for the heating element;

the control circuit including a control element for activating said temperature control;

said control circuit including at least one measuring instrument for determining at least one electric variable ($v_o$, $i_o$, P, I) of said control circuit, said electric variable depends on the temperature (T) of said heating element;

in that the control circuit (2) is operable to ensure that said temperature (T) of said heating element conforms to a predetermined temperature value at at least one later point in time (t2-t7) in that said control circuit is designed for determining a reference value ($F_R$) dependent on the electric variable ($v_o$, $i_o$, P, I) at an activating point in time of the temperature control and for determining a comparative value ($F_V$) dependent on the electric variable ($v_o$, $i_o$, P, I) at at least a later point in time (t2-t7), in that the control circuit (2) comprises a comparison unit (12) for determining a deviation of the comparative value ($F_V$) from the reference value ($F_R$), and in that the control circuit (2) comprises a control unit (12) for controlling the power regulator (10) independently of the deviation, for temperature control of the heating element (3) to a constant value corresponding to the reference value ($F_R$).

18. The induction oven according to claim 17, including said heating element is at least a portion of a wall of said induction oven.

19. The induction oven according to claim 17, including said heating element is at least a portion of a baking tray.

* * * * *